US005765353A

United States Patent [19]

Roland et al.

[11] Patent Number: 5,765,353

[45] Date of Patent: Jun. 16, 1998

[54] METHOD AND APPARATUS FOR POT SPINNING

[75] Inventors: Volker Roland, Weissbach; Peter Voidel, Chemnitz; Matthias Seifert, Lugau; Peter Spröd, Chemnitz, all of Germany

[73] Assignee: W. Schlafhorst AG & Co., Moenchengladbach, Germany

[21] Appl. No.: 670,544

[22] Filed: Jun. 27, 1996

[30] Foreign Application Priority Data

Jun. 30, 1995 [DE] Germany ..... 195 23 835.4

[51] Int. Cl.[6] ..... D01H 1/08; D01H 13/26

[52] U.S. Cl. ..... 57/76; 57/264

[58] Field of Search ..... 57/76, 312, 77, 57/264, 265, 267

[56] References Cited

U.S. PATENT DOCUMENTS

| | | | |
|---|---|---|---|
| 3,099,829 | 7/1963 | Namenyi-Katz | 340/259 |
| 4,040,240 | 8/1977 | Fujioka et al. | 57/76 X |
| 4,848,075 | 7/1989 | Frentzel-Beyme | 57/264 |

FOREIGN PATENT DOCUMENTS

| | | |
|---|---|---|
| 0 575 620 A1 | 12/1993 | European Pat. Off. . |
| 842 916 | 7/1952 | Germany . |
| 21 834 | 9/1961 | Germany . |
| 73 269 | 5/1970 | Germany . |
| 26 21 900 A1 | 1/1977 | Germany . |
| 41 03 771 A1 | 8/1992 | Germany . |
| 41 08 929 A1 | 9/1992 | Germany . |
| 43 24 039 A1 | 1/1995 | Germany . |
| 348346 | 9/1960 | Switzerland . |

OTHER PUBLICATIONS

Karl Lieven, "Fuzzy Technologien –Neue Möglichkeiten zur effizienten Entscheidungsfindung," MIT–Management Intelligenter Technologien GmbH.

*Primary Examiner*—Daniel P. Stodola
*Assistant Examiner*—Tina R. Taylor
*Attorney, Agent, or Firm*—Kennedy Covington Lobdell & Hickman, LLP

[57] ABSTRACT

A pot spinning method and apparatus wherein a spinning pot rotates during spinning about a vertical axis while an associated yarn guide tube delivers fiber material through an exit mouth of the yarn guide tube onto the rotating inside surface of the spinning pot in the form of a revolving extent of the yarn which also rotates about the axis of the spinning pot. A yarn break or unacceptable changes in quality of the spun yarn can be ascertained extraordinarily quickly if deviations in the duration of the revolution of the yarn extent at the mouth of the yarn guide tube are monitored.

11 Claims, 4 Drawing Sheets

METHOD AND APPARATUS FOR POT SPINNING

FIELD OF THE INVENTION

The present invention relates to a method and apparatus for pot spinning on a machine having a plurality of spinning pots each rotating about a yarn spinning axis with a tubular yarn guide associated with the spinning pot, wherein fiber material is supplied to the yarn guide, carried through the yarn guide tube to a mouth opening into the spinning pot, and therefrom placed against the rotating inner surface of the spinning pot in the form of a traveling extent of the yarn extending between the yarn guide tube and the inner surface of the spinning pot and rotating about the axis of the spinning pot. The so-called yarn cake formed in the process on the inside surface of the spinning pot is to be rewound after the conclusion of spinning on a rewinding tube held in readiness during the spinning operation at the yarn guide mouth and movable therefrom into a rewinding position.

BACKGROUND OF THE INVENTION

In pot or centrifugal spinning, fiber material drawn in a sliver drawing device, for instance a conventional drafting mechanism, is delivered into a rotating spinning pot (or centrifuge) through a traversing yarn guide tube, as described for instance in German Patent Disclosure DE 43 24 039 A1. The fiber material exits the mouth of the yarn guide tube in the form of a traveling extent of yarn rotating around the axis of the pot or centrifuge. As a result of the rotation of this extent of the yarn, the yarn to be produced is imparted the requisite twist before being deposited on the inner wall of the spinning pot in the so-called yarn cake. After the termination of a predetermined spinning time or once a certain yarn quantity in the spinning pot is attained, the yarn theretofore spun is rewound onto a rewinding tube that is inserted into the spinning pot at the appropriate time. The rewinding operation is initiated for instance by feeding the rewinding tube into the path of the extent of the yarn. In normal operation, the still-rotating extent of the yarn is firmly held by the rewinding tube, for instance by a catching notch located on the inserted end face of the rewinding tube, and the yarn cake previously deposited on the inner wall of the centrifuge is wound onto the rewinding tube.

In the event a yarn break occurs during the spinning operation, the end of the yarn traveling through the yarn guide tube is accelerated, even before it leaves the mouth of the yarn guide tube, from the spinning speed to the maximum speed equivalent to the particular circumferential speed of the yarn cake and is wrapped onto the yarn cake, whereby the yarn end is often no longer manipulable or, in any case, can no longer be manipulated automatically. The rewinding operation can then be initiated only from outside by relatively complicated provisions, generally manually (see Swiss Patent CH 348 346 or German Patent DE 842 916).

According to a discovery on which the present invention is based, as will be more fully described below, the already-spun yarn cake within the spinning pot can still be rescued for further processing, i.e. rewound properly onto a rewinding tube, in the event of a yarn break, by utilizing a yarn sensor associated with the transport path of the fiber material to detect a yarn break and to transmit a signal to move the rewinding tube into its rewinding position before the broken yarn end has left the mouth of the yarn guide tube. Within the available time before the broken yarn end is lost onto the yarn cake, the trailing yarn end is clamped in the yarn guide tube or otherwise engaged with a suitable catching means so that the yarn may then be wound onto the rewinding tube. It will be appreciated that the yarn catching means must not be activated until the yarn break has been detected as such and it is accordingly important initially for the yarn break to be detected quickly and unequivocally.

Conventional yarn sensors, usually operating optically, capacitively or pneumatically, of the kind described in East German Patent DD 73 269, operate to detect a yarn break by recognizing the absence of a yarn and therefore generally do not detect a yarn break until the broken yarn end has traveled the distance between the clamping gap of the starting rollers of a furnishing drafting arrangement and the axis of the sensor. In pot spinning, there is no genuine yarn balloon formed nor does any other form of periodic yarn motion occur in the region of the drafting arrangement whereby periodic yarn signals (see German Patent Disclosure DE 26 21 900 A1) are not measurable. On the contrary, to take into account fluctuations in amplitude of the yarn thickness requires specifying a relatively long integration time in the yarn sensor. Therefore, with the conventional yarn monitors or detectors, it is not always possible to prevent the yarn end created in a yarn break from disappearing within the yarn cake.

One substantial disadvantage of conventional yarn monitors, especially in pot spinning where balloon development following the drafting arrangement does not occur, is also that a change in yarn quality, for instance in the number of yarn rotations per meter, is found only in extreme cases.

In some known pot-spinning machines, the standing spinning pot is accessible to the rewinding tube only from above (see East German Patent DD 21 834). There are also other pot-spinning machines with a vertically oriented so-called suspended spinning pot into which sliver is supplied via a tubular yarn guide but wherein the spinning pot is formed generally in a bell-like shape (i.e. open at the bottom) whereby the rewinding tube can be inserted into the spinning pot only from beneath (see German Patent Disclosure DE 41 03 771 A1). Finally, there are pot-spinning machines with an essentially cylindrical pot without a top and bottom, so-called tube centrifuges, both ends of which have an opening of virtually the same size. If these tubular spinning pots are used, the rewinding tube of DE 41 08 929 A1 can be held ready below the mouth of the yarn guide tube, or the rewinding tube of DE 43 24 039 A1 can be held ready on the yarn guide tube above its mouth. Thus the applicability of the present invention extends to all relevant types of pot-spinning machines.

OBJECT AND SUMMARY OF THE INVENTION

It is accordingly an object of the present invention to provide a method and an apparatus that make it possible in pot spinning to detect a deviation in yarn quality and in particular an incident yarn break earlier than with the conventional yarn monitors discussed above.

The invention is based on the knowledge that, upon a yarn break, the broken yarn end is rapidly accelerated to nearly the high circumferential speed of the spinning pot or yarn cake. As a consequence, the duration of each revolution of the extent of the yarn exiting the mouth of the yarn guide tube rises. Thus, according to the present invention, the measurement of this duration of yarn revolution makes it possible practically instantaneously to detect a yarn break, in fact in only one durational period after occurrence of a yarn break. If T is the duration of revolution, n is the rotary speed or rpm of the spinning pot, v is the spinning speed or in other words the supply speed of the yarn, and d is the yarn cake diameter, then the following equation expresses the duration of revolution T of the rotating extent of the yarn between the guide tube and the spinning pot:

$$T = \frac{a}{n - \frac{v}{\pi \times d}}$$

in which the constant "a" represents the conversion from minutes into milliseconds and has an order of magnitude of 1/60,000.

In operation of the pot-spinning machine, it will be understood that a change in rpm of the spinning pot while the yarn supply speed remains the same also causes a variation in yarn rotations and the duration of each yarn revolution or the rotational frequency of the extent of the yarn varies accordingly. That is, under certain circumstances the duration of revolution of the yarn extent decreases compared with a standard range, while if the yarn rotation is too slight the duration of each revolution of the yarn extent becomes higher compared with the standard range.

Accordingly, the present invention makes it possible to interrupt the spinning operation to initiate a rewinding operation not only in the event of an abrupt change in the measured duration of yarn revolution which reflects the occurrence of an extent of the yarn caused by a yarn break but also in the event of lesser or more gradual changes in the duration of revolution of the yarn reflecting changes in yarn quality, whereupon the invention generates a signal to initiate the rewinding operation, preferably by inserting the rewinding tube into the rewinding position. For this purpose, the present invention utilizes a revolution measuring instrument or revolution evaluating instrument to detect such changes and to automatically send a signal for immediate feeding of the rewinding tube into the rewinding position. Thus, if the yarn quality varies unacceptably, then the corresponding spindle can be switched off and the yarn already spun there can be rescued.

In conventional methods of detecting a yarn break on a yarn-producing machine, the goal is, if at all possible, to detect the yarn break at the point where it occurs. By way of example, corresponding sensors in German Patent Publication DE 26 21 900 A1 are positioned practically immediately following the last pair of delivery rollers of the preceding drafting arrangement. The present invention departs entirely from this measurement location and contemplates first observing the rotating extent of the yarn at a location outside the exit mouth of the yarn guide tube. Despite this extremely late monitoring of the yarn along the lineal course of yarn travel, it is nevertheless surprisingly possible to recognize a yarn break or a change in the yarn quality earlier in terms of time than with the known sensors which observe the yarn at a much more upstream location along its course of travel.

Further applications may be made of the calculated measurement variable T representing the duration of yarn revolution by analyzing this value together with other variables which influence the spinning operation, as input signals for a complex machine control based on so-called fuzzy logic. In that case, slowly drifting process parameters that are relevant to yarn quality, such as variations in rpm of individual spinning pots, which leads to an insidious change in the twisting rotations attained in the spun yarn and thus to changes in quality, can be detected punctually, and requisite corrections can be made by triggering suitable actuators. Alternatively, if given tolerance limits are exceeded, the rewinding operation can be initiated by inserting the rewinding tube, after which the work station can be shut down.

The invention will be described in further detail below in terms of exemplary embodiments shown in the drawings.

DESCRIPTION OF THE PREFERRED EMBODIMENTS

Figure 1:
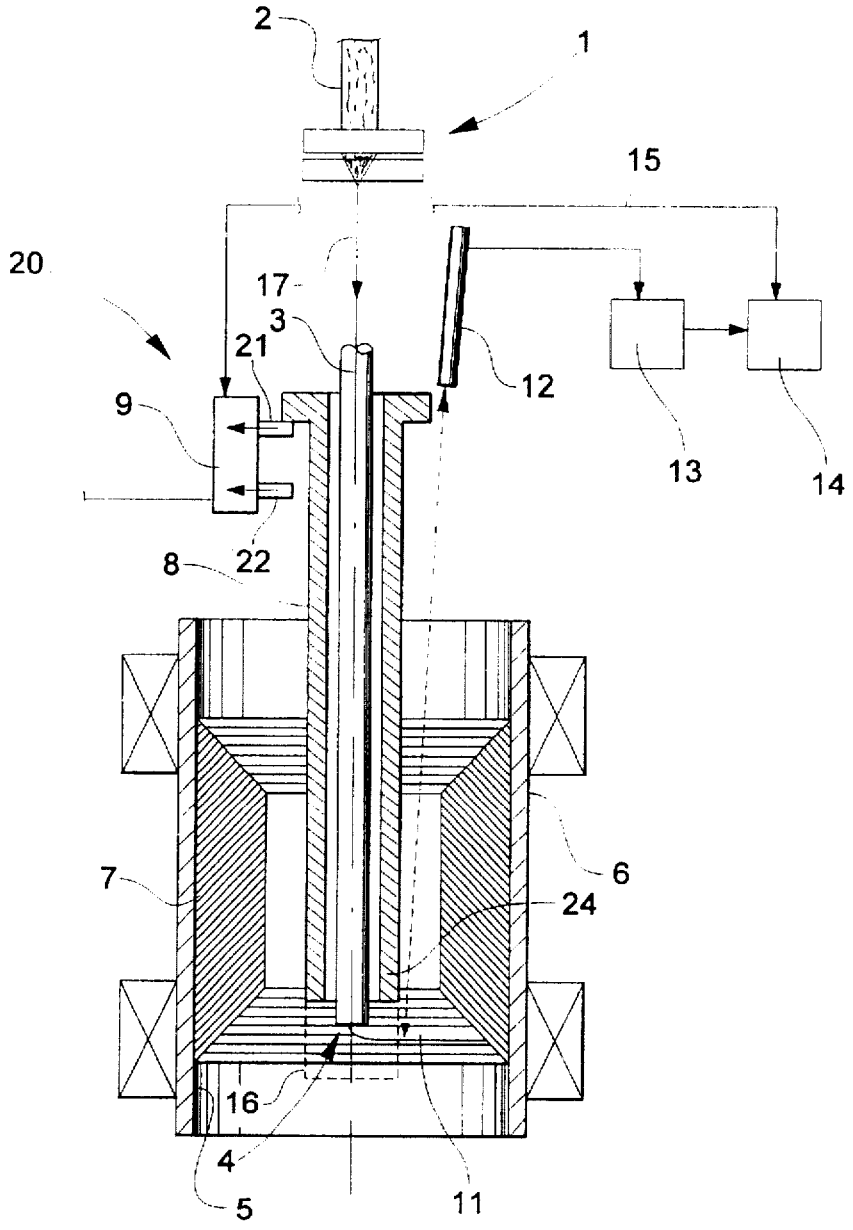
FIG. 1 schematically shows a first exemplary embodiment of a pot-spinning machine in vertical cross-section, having a rewinding tube held in readiness on the yarn guide tube, and a sensor device embodied as a light scanner.

In FIG. 1, one representative spinning station of a pot-spinning machine is indicated generally at 20, each such spinning station 20 being supplied with sliver 2 via a sliver drawing device, indicated by way of example as a drafting arrangement 1, and being operative by the action of a spinning pot 6 rotating about its center axis 10 to spin the drawn sliver 2 into a yarn 17. The yarn 17 passes through a tubular yarn guide 3 extending coaxially into the spinning pot 6 and emerges from the exit mouth 4 of the yarn guide 3 in the form of a leading extent 11 of the yarn.

Under the influence of the rotating spinning pot 6, the yarn extent 11 extends laterally toward and revolves in the direction of rotation of the spinning pot 6 and the yarn 17 is thereby applied and joined to a yarn cake 7 which forms progressively during the spinning operation on the inner circumferential wall 5 of the spinning pot 6.

A rewinding tube 8 is held by means of a releasable latch device 9 in a readiness position 24 (shown in full lines) coaxially about the yarn guide tube 3 a slight distance above the exit mouth 4 of the yarn guide 3. The latch device 9 has by way of example two locking pins 21, 22 that are triggerable in defined fashion. Specifically, by retraction of the bolt 21, the rewinding tube 8 can be released as a function of a suitable control signal to drop gravitationally into a lower rewinding position 16, shown in broken lines in the drawings, in which the rewinding tube 8 grasps the revolving yarn extent 11 by means of yarn clamping devices or the like located in the vicinity of the face end of the rewinding tube 8 and thus initiates the rewinding operation. The bolt 22 of the latch device 9 functions as a stop that limits the downward motion or feeding of the rewinding tube 8, and thereby predetermines the rewinding position 16.

The spinning station 20 is also equipped with a sensor device, which as shown in FIG. 1 may for instance be embodied as a light scanner 12. The sensor device is connected to a pulse shaper stage device 13, which is connected in turn to a monostable multivibrator 14 the output 15 of which is connected to the latch device 9.

Figure 2:
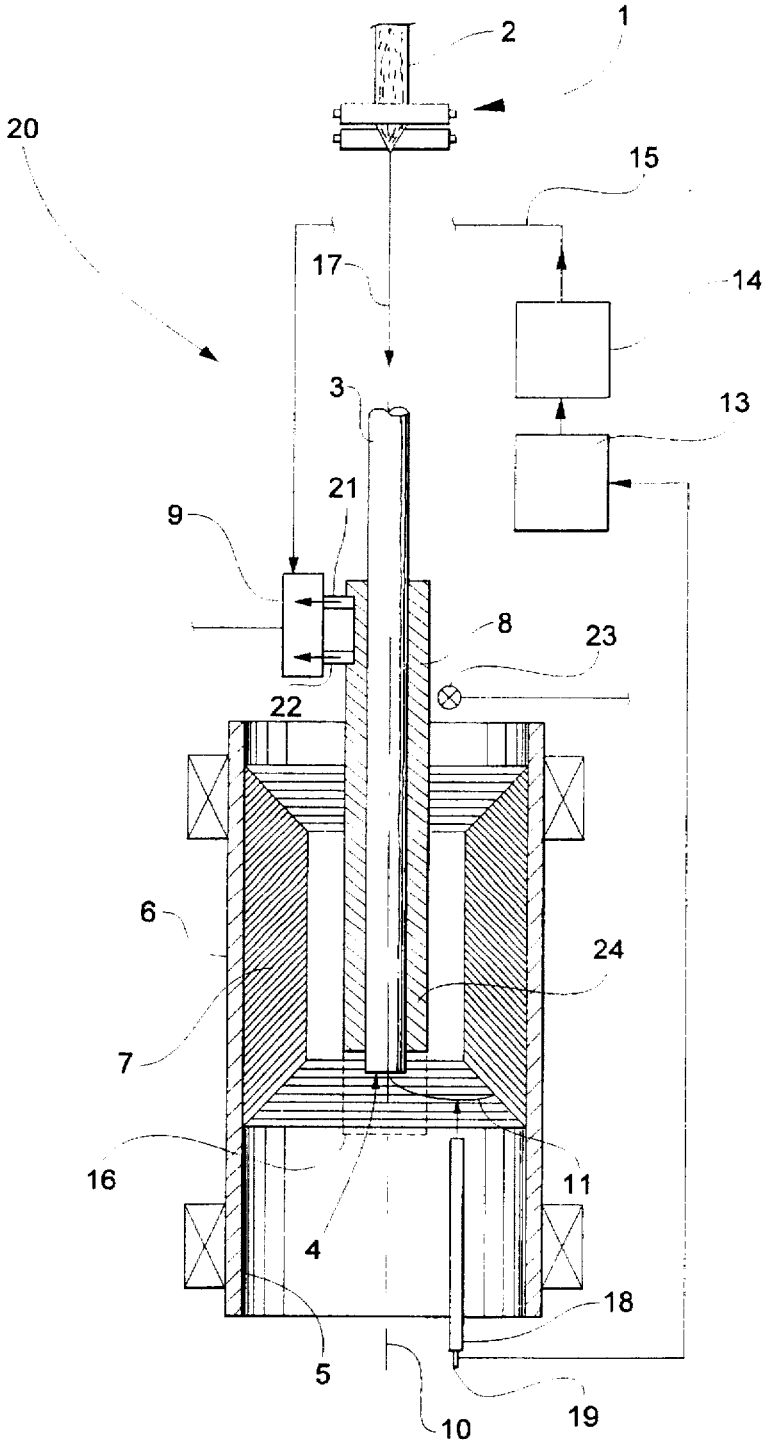
FIG. 2 shows a further exemplary embodiment of a pot-spinning machine in vertical cross-section, having a sensor device embodied as a photoelectric barrier.

The spinning station 20 shown in FIG. 2 differs from the spinning station of FIG. 1 essentially in that, instead of a light scanner, a photoelectric barrier is used as the sensor device. In this embodiment, a transmitter 23 of the photoelectric barrier is disposed just above the spinning pot 6 and a compatible receiver 18 just below the spinning pot 6. The optical axis between the transmitter and the receiver extends directly through the area swept by the rotating loose yarn end 11. The output signal of the receiver 18 of the photoelectric barrier is converted, via the pulse shaper stage device 13 and the monostable multivibrator 14, into a signal for the latch device 9.

Figure 3:
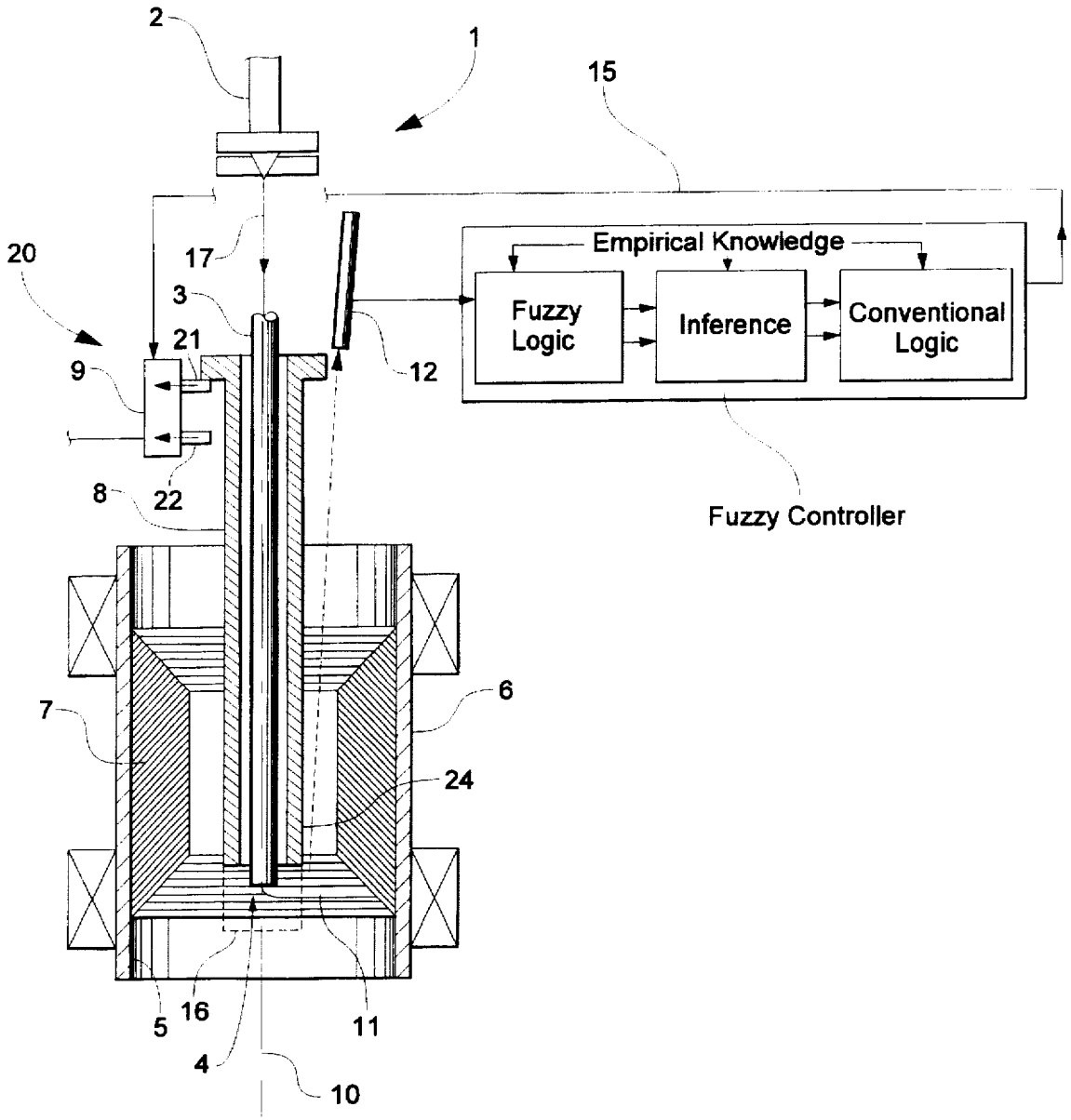
FIG. 3 shows another exemplary embodiment of a pot-spinning machine in vertical cross-section, utilizing a fuzzy logic controller.

Likewise, the spinning station of FIG. 3 utilizes a light scanner 12 as in FIG. 1 but delivers the output signal of the scanner to a fuzzy logic controller, whose output controls the operation of the latch device 9. The basic operation of such controllers is known, as represented for example by the article by Karl Lieven, of the MIT-Management Intelligenter Technologien GmbH, Aachen, Germany, entitled "Fuzzy Technologies—Neue Möglichkeiten zur effizienten Entscheidungsfindung," which is incorporated herein by reference.

Mode of Operation

Figure 4:
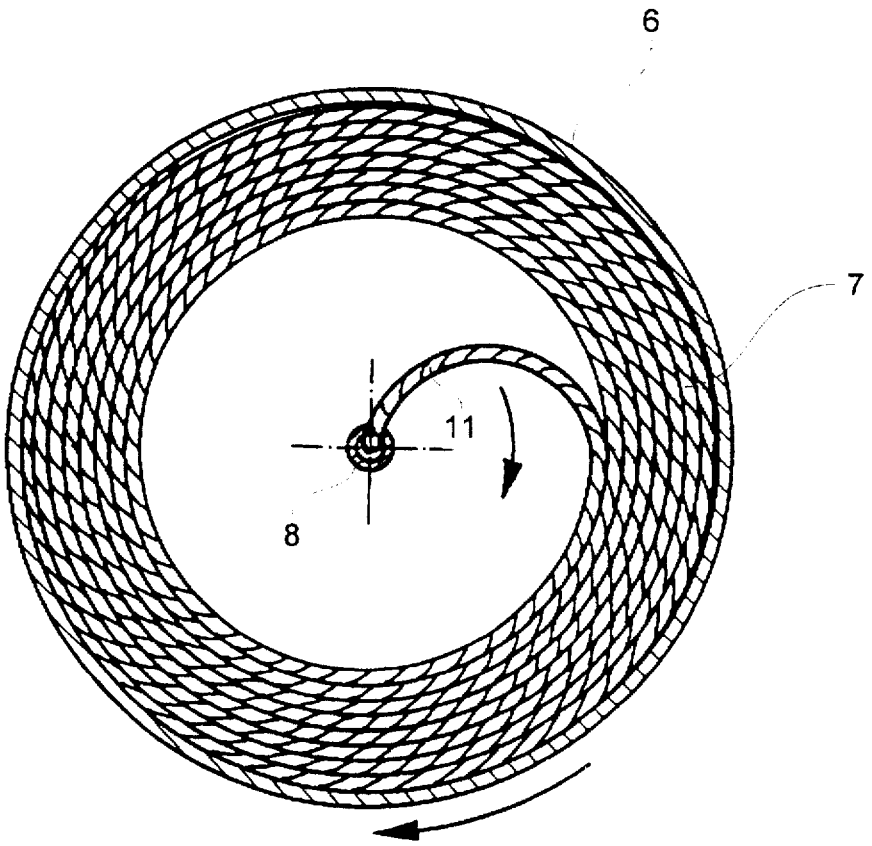
FIG. 4 depicts a horizontal cross-section representative of the spinning operation of each of the embodiments of FIGS. 1–3.

In operation, the yarn 17 travels inside the yarn guide 3 essentially axially with respect to the spinning pot 6 which rotates at high speed about its axis 10. At the exit mouth 4 of the yarn guide 3, the yarn transport direction is deflected by approximately 90 degrees to extend to the yarn cake 7, during which the traveling yarn extent 11 revolves around the pot axis 10 under the influence of the centrifugal force of the rotating spinning pot at a frequency f=1/T. Since the delivery speed v (spinning speed) of the yarn extent 11 is relatively low in proportion to the circumferential speed of the spinning pot 6, the yarn extent 11 does not move exactly radially from the mouth 4 to the yarn cake 7 but rather follows an arcuate or curved course, which opens virtually asymptotically into the inner circumferential face of the yarn cake 7, as shown in FIG. 4. To the point thus far described, the operation of the exemplary embodiment shown are already known. The other provisions for initiating the rewinding of the yarn cake 7 onto the rewinding tube 8 may also be done in the conventional way.

According to the present invention, the optical axis of the sensor 12 or 19 is aimed at a spot on the surface of the yarn cake 7 contacted by the rotating yarn extent 11, so that the sensor 12 or 19 can detect the duration of each revolution T of the rotating yarn extent 11. Measuring instruments that make it possible to determine the duration of revolution T of an orbiting yarn extent 11 and to transmit a signal representing deviations in the duration of revolution from a set-point value range are known for instance from U.S. Pat. No. 3,099,829 or German Patent Disclosure DE 26 21 900 A1.

In the exemplary embodiment of FIGS. 1 and 2, the pulse generated at the sensor 12 or 19 per revolution of the yarn extent 11 is delivered to the pulse shaper stage device 13 which amplifies the signal and generates needle pulses for triggering the following retriggerable monostable multivibrator 14. The hold time of the monostable multivibrator 14 is dimensioned such that in the normal spinning mode, or, in other words, within the set-point value range of the duration of revolution of the traveling extent 11 of the yarn, the next trigger pulse will occur just before the end of the hold time. The output signal of the monostable multivibrator 14 does not change in such case. However, if upon a yarn break or an unacceptable change in the yarn quality, one of the following periods exceeds the hold time, then the output 15 of the monostable multivibrator 14 is switched over until the arrival of the next trigger pulse.

Once the monostable multivibrator 14 is switched over, then resetting can take place only by means of a reset pulse at a special input. The longest still acceptable period length at which no yarn break (or unacceptable change in yarn quality) is yet reported must match the hold time of the monostable multivibrator 14. The hold time must be adapted, via a programming input of the monostable multivibrator 14, to the current rpm of the spinning pot 6 and to the delivery speed of the yarn 17.

The signal output at the output 15 of the monostable multivibrator 14 is used in the exemplary embodiment to release the bolt 21 of the latch device 9, so that, in the event of an unacceptable change in the duration of revolution of the traveling extent 11 of the yarn, the rewinding tube 8 will drop or be thrust out of the readiness position 24 into the rewinding position 16, represented by dashed lines, virtually instantaneously but in any case still before the yarn end, in the event of a yarn break, leaves the mouth 4 of the yarn guide 3.

In the embodiment of FIG. 3, the pulses generated at the sensor 12 are delivered to the fuzzy logic controller whose control program is adapted according to known principles of so-called fuzzy logic to analyze the pulses, in comparison with a set point value, along with analysis of any other relevant process variables which may affect the spinning operation, such as for example the rotational speed of the spinning pot or the delivery speed of the yarn, for purposes of recognizing not only yarn breakages but also more gradual changes in yarn quality, and in turn to actuate the latch device 9.

As will thus be understood, in any method for pot spinning on a machine having one or more rotating spinning pots each with an associated yarn guide tube through which a loose yarn end exits from the mouth of the yarn guide tube in a rotating manner as it is applied onto the rotating inside surface of the spinning pot, a yarn break or unacceptable changes in quality of the spun yarn can be ascertained extraordinarily quickly by monitoring the circulation time of the traveling yarn extent rotating at the exit mouth of the yarn guide tube.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for pot spinning comprising the steps of rotating a spinning pot about a spinning axis, delivering a yarn onto an inner circumferential surface of the spinning pot through an exit mouth of a tubular yarn guide in the form of a traveling extent of the yarn revolving about the axis of the spinning pot, and monitoring deviations in the delivery of the yarn by detecting deviations in a duration of revolution of the traveling yarn extent at the mouth of the yarn guide tube.

2. The method of claim 1, and further comprising the steps of comparing the duration of revolution with a set-point value and generating a deviation signal if the set-point value is exceeded.

3. The method of claim 2, wherein the set-point value of the duration of revolution is predetermined from process-dictated setting values.

4. The method of claim 3, wherein the process-dictated setting values comprise the rotational speed of the spinning pot and the delivery speed of the yarn.

5. The method of claim 2, and further comprising the step of initiating a rewinding operation by feeding of a rewinding tube from a reserve position into a rewinding position in response to the generated deviation signal.

6. The method of claim 2, and further comprising the steps of delivering the duration of revolution as an input signal to a complex process controller for comparison with the set point value and for further processing in conjunction with additional process variables.

7. The method of claim 6, wherein the processing of the duration of revolution of the rotating loose yarn end is performed in a fuzzy logic controller.

8. The method of claim 1, wherein the duration of revolution of the yarn extent is detected continuously.

9. The method of claim 1, and further comprising measuring the duration of revolution of the rotating yarn extent and comparing the measured duration of revolution with a set-point value that takes into account the then-current inside diameter of the yarn within the spinning pot.

10. An apparatus for pot spinning of yarn comprising a spinning pot rotatable about a spinning axis for formation of a yarn cake on an inner circumferential surface of the spinning pot, a tubular yarn guide having an exit mouth for delivering a yarn into the spinning pot in the form of a traveling extent of the yarn revolving about the axis of the spinning pot, and means for monitoring deviations in the delivery of the yarn, the monitoring means including means for detecting a duration of revolution of the traveling yarn extent at the mouth of the yarn guide tube.

11. An apparatus according to claim 10, wherein the detecting means comprises an optical sensor oriented at a location on the inner circumferential surface of the spinning pot, a monostable multivibrator connected to the sensor and having a hold time equivalent to predetermined maximum and minimum values for the duration of revolution of the yarn extent.

* * * * *